United States Patent [19]

Lee

[11] Patent Number: 4,585,059

[45] Date of Patent: Apr. 29, 1986

[54] HEAT TRANSFER TUBE ASSEMBLY

[75] Inventor: Marlow Lee, Clawson, Mich.

[73] Assignee: H & H Tube & Mfg. Co., Southfield, Mich.

[21] Appl. No.: 419,723

[22] Filed: Sep. 20, 1982

Related U.S. Application Data

[63] Continuation of Ser. No. 112,393, Jan. 15, 1980, abandoned.

[51] Int. Cl.[4] ..... F28D 7/14; F28F 1/00

[52] U.S. Cl. ..... 165/154; 165/180; 138/113; 138/114; 138/148; 285/382.1; 285/133.1

[58] Field of Search ..... 165/154, 180, 177, 109, 165/141, 70; 138/115, 113, 114, 148, 44; 29/455 R, 521; 285/382.1, 382.2, 133 R

[56] References Cited

U.S. PATENT DOCUMENTS

| | | | |
|---|---|---|---|
| 470,514 | 3/1892 | Simpson | 285/382.2 |
| 988,477 | 4/1911 | Lillie | 165/154 |
| 1,150,407 | 8/1915 | Wells | 165/154 |
| 1,157,226 | 10/1915 | Kenny | 285/382.2 |
| 1,186,572 | 6/1916 | Guibert | 29/455 R |
| 1,618,611 | 2/1927 | Trout | 29/455 R |
| 1,637,750 | 8/1927 | Kilham | 285/382.2 |
| 2,174,010 | 9/1939 | Patterson | 29/508 |
| 2,259,433 | 10/1941 | Kitto | 165/154 |
| 2,634,759 | 4/1953 | Twickler | 29/455 R |
| 2,878,837 | 3/1959 | Burtt | 165/154 |
| 3,173,196 | 3/1965 | Grimm | 138/114 |
| 3,242,558 | 3/1966 | Selig | 29/455 R |
| 3,386,497 | 6/1968 | Feldmeier | 165/154 |
| 3,507,324 | 4/1970 | Mueller | 165/154 |
| 3,785,170 | 1/1974 | Beranek | 165/154 |
| 4,372,374 | 2/1983 | Lee | 165/70 |
| 4,451,966 | 6/1984 | Lee | 29/521 |

FOREIGN PATENT DOCUMENTS

| | | | |
|---|---|---|---|
| 2239821 | 2/1974 | Fed. Rep. of Germany | 29/455 R |
| 327455 | 1/1958 | Switzerland | 165/154 |
| 725075 | 3/1955 | United Kingdom | 165/154 |
| 977579 | 12/1964 | United Kingdom | 165/154 |

*Primary Examiner*—William R. Cline
*Assistant Examiner*—John K. Ford
*Attorney, Agent, or Firm*—Hauke & Patalidis

[57] ABSTRACT

A heat transfer tube assembly comprising a pair of fluid circulation tubes disposed co-axially one within the other, the inner tube being held substantially concentric within the outer tube by a plurality of pairs of diametrally opposed depressions or dimples formed in the peripheral surface of the outer tube at regular intervals. Each depression or dimple projects inwardly such as to engage and indent the peripheral surface of the inner tube and to cause a corresponding portion of the inner tube to bulge inwardly during forming of the dimples in the periphery of the outer tube by forming punches or, preferably, by two pairs of diametrally opposed rolls, each provided with an appropriate dome-shaped protuberance on its peripheral surface for roll forming the dimples as a result of longitudinally feeding the outer tube, with the inner tube disposed within the outer tube, between the rotating rolls. Preferably, the inner tube is double-walled and the axes of consecutive pair of opposite dimples are disposed at right angle to each other. The inner tube is thus coaxially supported within and assembled to the outer tube by the dimples, and a fluid may be circulated through the inner tube while another fluid is circulated in the annular space between the peripheral surface of the inner tube and the inner surface of the outer tube with the result that, when the fluids are at different temperatures, heat may be transferred from one fluid to the other through the wall of the inner tube.

6 Claims, 5 Drawing Figures

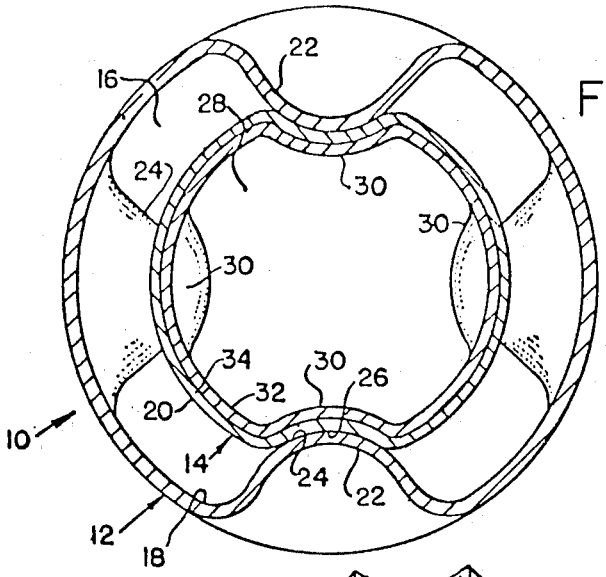
FIG. 2
FIG. 4
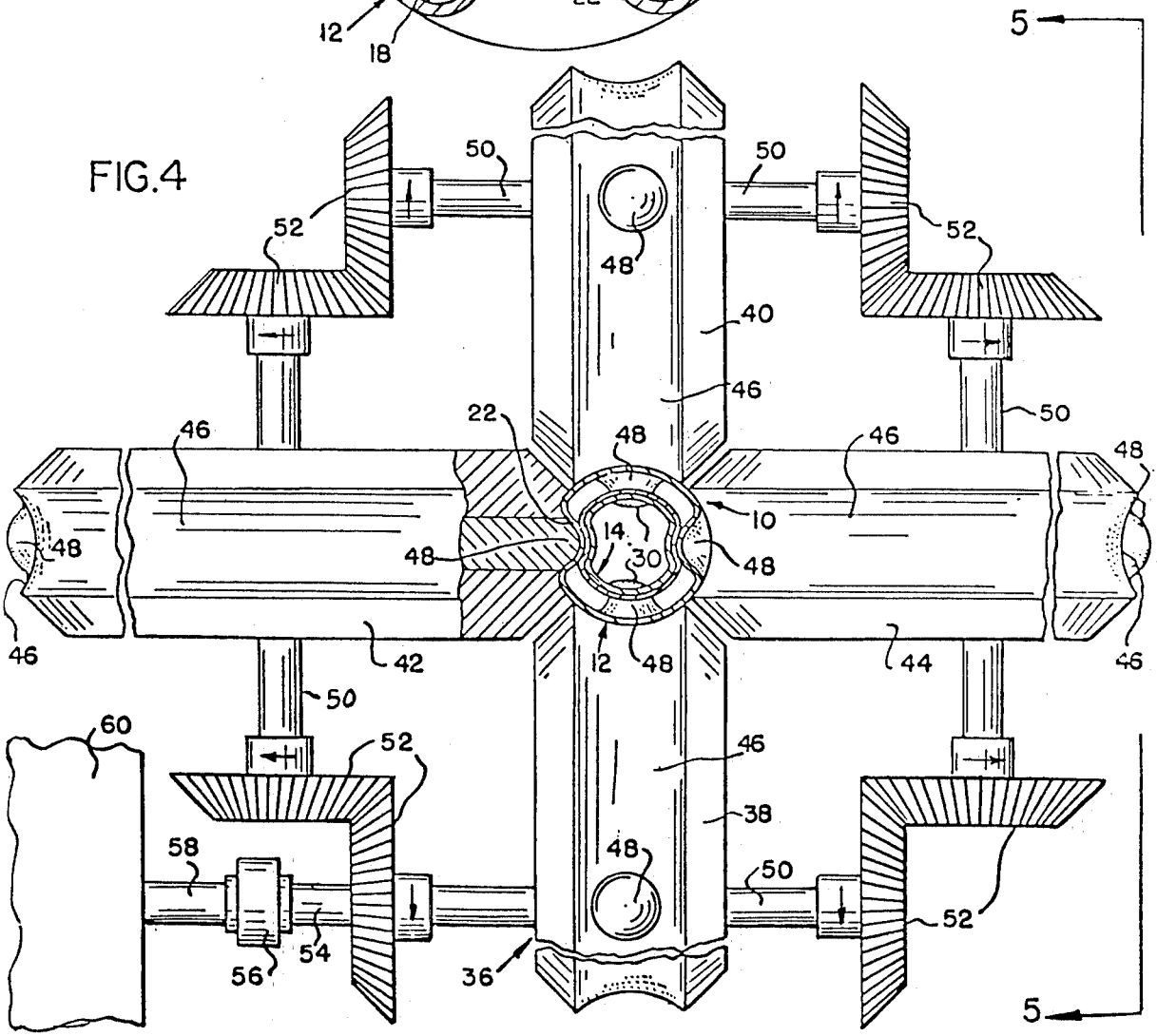

HEAT TRANSFER TUBE ASSEMBLY

CROSS-REFERENCE TO RELATED APPLICATIONS

The present application is a continuation application of application Ser. No. 112,393, filed Jan. 15, 1980, now abandoned, and is copending with application Ser. No. 291,555, filed Aug. 10, 1981, now U.S. Pat. No. 4,451,966 which is a divisional aplication of application Ser. No. 112,393, filed Jan. 15, 1980. This application is related to application Ser. No. 166,957, filed July 8, 1980, now U.S. Pat. No. 4,372,374, issued Feb. 8, 1983, also a continuation-in-part of application Ser. No. 112,393, filed Jan. 15, 1980.

BACKGROUND OF THE INVENTION

The present invention is concerned with a structure for heat transfer tube for heat exchangers and the like, and with the apparatus and method for manufacturing the same.

Heat exchangers are commonly used for the purpose of transferring heat from the flowing liquid in an enclosure to another fluid flowing in an adjacent enclosure without intermixing the fluids. Heat exchangers are in common use in some applications of solar heating devices utilizing a fluid, such as a liquid flow of high heat absorbing capacity, circulating through a primary fluid flow circuit connected to the solar heat absorber, and where it is desired to transfer the heat from the heated fluid in the primary circuit to another fluid, such as ordinary water or air, circulating in a secondary fluid flow circuit. Heat exchangers also are commonly used in marine and in stationary industrial internal combustion engine installations for absorbing heat from the engine closed cooling system, and in nuclear reactors for cooling the reactor and for utilizing the heat generated by the reactor.

Heat exchangers are often complex devices with many welded or brazed fittings and connections, and they are subject to rapid deterioration, especially when one of the fluids has a corrosive action on the wall of the containing vessels, conduits, and junctions. Conventional heat exchangers are bulky, expensive to fabricate, subject to corrosion and prone to develop leaks.

SUMMARY OF THE INVENTION

The present invention remedies the inconveniences of conventional heat exchangers by providing a novel structure for heat transfer tubes for use in heat exchangers, which can be mass-produced in convenient sizes and lengths, and which can be cut from stock to any appropriate lengths for fabricating heat exchanger units of any desired capacity by interconnecting by means of conventional fittings. The heat transfer tubes of the invention may be mass-produced at low cost on continuous lines or in batches by means of simple tooling, and consist essentially of an assembly of two conventional tubular elements mounted one within the other and held in spaced apart relationship concentrically to each other by simple wall deformation of the elements, thus requiring no separate holding and connecting members, and no welding, soldering or brazing.

The diverse objects and advantages of the present invention will become apparent to those skilled in the art when the following description of the best mode contemplated for practicing the invention is read in conjunction with the accompanying drawing wherein:

BRIEF DESCRIPTION OF THE DRAWING

FIG. 1 is an elevation view of a length of heat transfer tube according to the present invention;

FIG. 2 is a transverse section along line 2—2 of FIG. 1;

FIG. 3 is a view similar to FIG. 1 with portions cut away to show the internal construction and with both ends of the length of heat transfer tube cut off for mounting a fitting thereon, one end being shown provided with a fitting; and FIGS. 4–5 are schematic views of an apparatus for fabricating the heat transfer tube of the invention.

DETAILED DESCRIPTION OF THE PREFERRED EMBODIMENT

Figures 1, 3, 5:
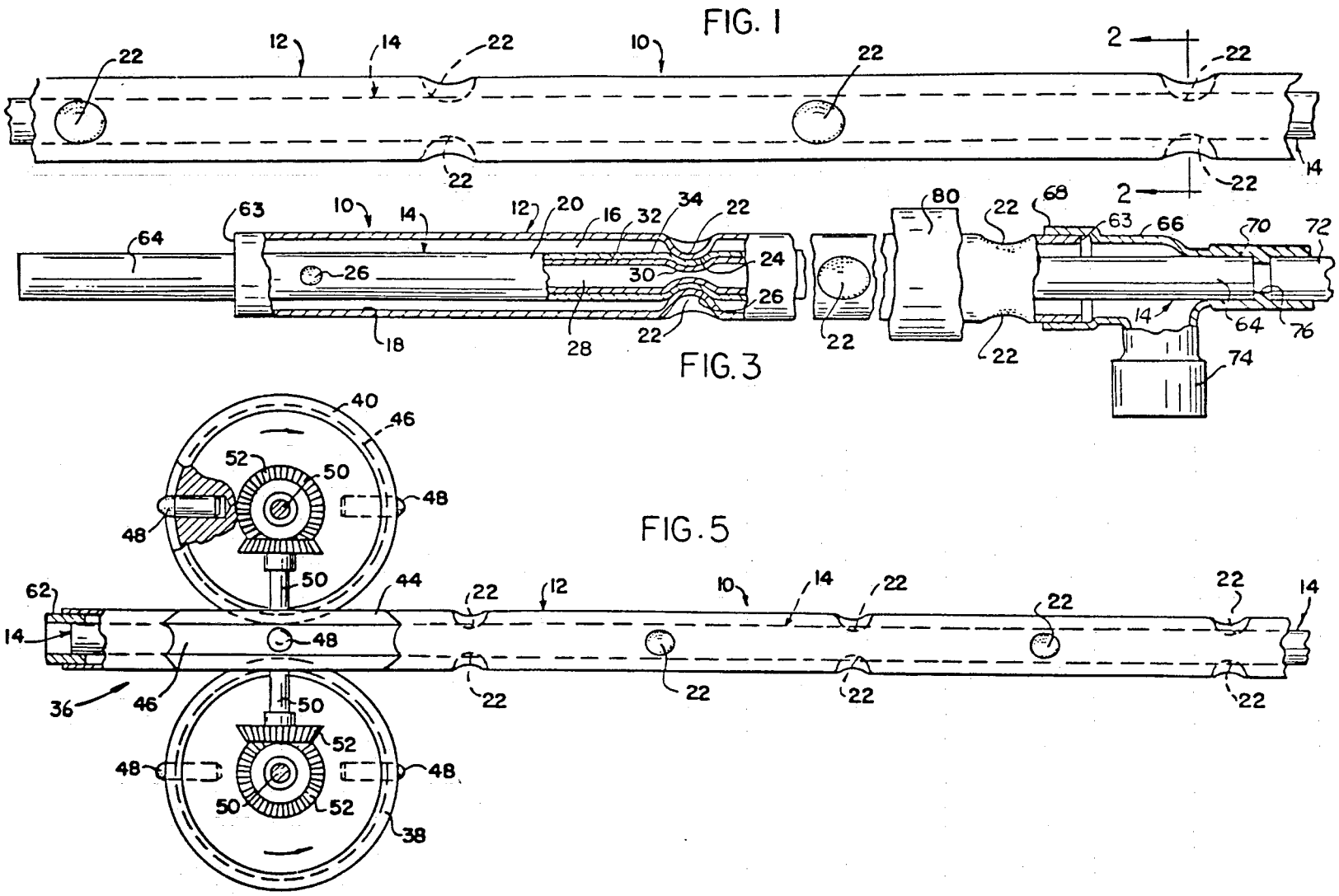

Referring now to the drawing, and more particularly to FIGS. 1–3, a heat transfer tube 10 according to the present invention comprises a metallic elongated tubular conduit member or tube 12 having a second elongated tubular conduit member or tube 14 rigidly mounted concentrically within the outer tubular conduit member or tube 12, such that a generally annular space 16 is formed between the interior wall surface 18 of the outer tube 12 and the peripheral surface 20 of the inner tube 14. The inner tube 14 is held substantially concentric to the outer tube 12 as a result of the outer tube 12 being provided with a plurality of concave indentations or dimples 22 projecting inwardly and radially such as to form a domed surface 24, FIGS. 2 and 3, engaged into a conforming inwardly directed depression or recess 26 formed in the peripheral surface 20 of the inner tube 14. Preferably, a pair of diametrally disposed dimples 22 are formed at regular intervals, the axis of the dimples in each pair being at a right angle to the axis of the next consecutive pair of dimples 22. In this manner, the inner tube 14 is held co-axially within the larger outer tube 12, without requiring any welding, brazing or other assembly arrangement, and an appropriate fluid, such as a liquid, may be longitudinally circulated through the annular space 16, while another fluid may be circulated through the interior 28 of the inner tube 14.

The inner tube 14 is made of welded-seam or, preferably, seamless metallic tube such as copper tubing and the like, providing good heat transfer from the interior 28 of the inner tube 14 through its wall to the annular space 16 surrounding its peripheral surface 20. The outer tube 12 is also made of metallic seamless or welded-seam tubing, preferably of the same material as the inner tube 14 to prevent electrolytic corrosion of the wetted surfaces, especially where the surfaces are proximate or in firm contact with each other, for example where the domed surface 24 of the dimples 22 formed in the outer tube 12 engages the surface of the recess 26 formed in the peripheral surface 20 of the inner tube 14. Disposing the dimples 22 in diametrically opposed pairs with the axis of each pair at substantially a right angle to the axis of the adjoining diametrically opposed pairs of dimples tends to divert the flow of fluid through the annular space 16 and creates turbulence which facilitate the heat exchange between the fluid circulating in the annular space 16 and the fluid circulating through the interior 28 of the inner tube 14. The recesses 26 are formed by deformation of the wall of the inner tube 14 such as to cause on the interior 28 of the tube diametrically opposed pairs of convex projections 30 which, without causing undue restriction to the flow of fluid through the interior 28 of the inner tube 14, tend to agitate and cause turbulence of the fluid circulating through the interior 28 of the inner tube 14.

Preferably, the inner tube 14 is double-walled, as illustrated, i.e. made of an inner tubular conduit 32 disposed within an outer tubular conduit 34, the outer conduit 34 being shrunk by rolling or, preferably, passage through a sizing die for reducing its diameter while simultaneously reducing slightly the diameter of the inner conduit 32, with the result that the inner surface of the outer conduit 34 is intimately in contact with the peripheral surface of the inner conduit 32. Providing the inner tube 14 in this manner with a double wall presents the advantages of increasing the strength of the inner tube, controlling wall porosity and preventing leakage in the event that one of the conduits tears or becomes excessively corroded, and thus provides a substantially improved structure in many installations where it is desired to prevent accidental intermixing between two fluids during transfer of heat from one fluid to the other. If it is desired, the outer tube 12 may also be double-walled.

The heat transfer tube 10 of the invention can be manufactured on a continuous line, or by batches, in considerable lengths, the assembly of the inner tube 14 within the outer tube 12 being effected by a roll apparatus 36, for example, as schematically illustrated at FIGS. 4–5. The apparatus 36 comprises four steel rolls 38, 40, 42 and 44 diametrically disposed in pairs, relative to the heat transfer tube 10 in the process of being assembled, along orthagonal axes and rotatably supported by an appropriate frame, not shown. Each roll has a peripheral concave groove-like surface 46 rollingly and drivingly engageable with substantially one fourth of the peripheral surface of the outer tube 12 of the heat transfer tube 10, and the concave groove-like surface 46 is provided, for example, with a pair of diametrally disposed dome-like knobs or projections 48, each adapted to act as a drawing punch to form a dimple 22 in the peripheral surface of the outer tube 12 during simultaneous rotation of the four rolls 38–44 causing the tube 12, with the tube 14 disposed within, to be displaced longitudinally during fabrication of the heat transfer tube 10. The inner tube 14 is thus continuously assembled within the outer tube 12 as a result of the dimples 22 being formed at regular distances from each other, the distance between consecutive longitudinally aligned dimples being equal to the length of the arc of circle separating the projections 48 on the periphery of a roll 38–44.

Each roll 38–44 is supported and driven by a drive shaft 50 and the four drive shafts 50 are coupled together by way of meshing bevel gears 52. One of the roll drive shafts 50 is coupled through a shaft extension 54 and a coupling 56 to the output shaft 58 of an electric motor 60. Each pair of meshing bevel gears 52 has a one-to-one drive ratio, and the opposite rolls, such as rolls 38 and 40 and rolls 42 and 44, of each pair of rolls are rotatively driven in opposite directions, as shown by the arrows, in appropriate timing to simultaneously cause their respective dome-like projecting portions or knobs 48 to draw inwardly each a corresponding portion of the wall of the outer tube 12 such as to form therein a pair of opposite dimples 22, diametrally disposed relative to the tube 12. The depth of drawing of the dimples 22 is adequately chosen as a function of the difference between the radii of the outer tube 12 and of the inner tube 14 such that each protuberance or knob 48 drawing a dimple 22 causes the domed surface 24 of each dimple 22 to draw inwardly a corresponding portion of the peripheral wall of the inner tube 14, thus forming a recess 26. The domed surface 24 of each dimple 22 is pressed in and firmly engaged within the recess 26 formed in the peripheral surface 20 of the inner tube 14. The timing of the diverse bevel gears 52 is such as cause the diametrally opposed protuberances or knobs 48 of the pair of opposite rolls 38 and 40 to draw opposite dimples 22 along a diameter of the tube 12 perpendicular to the diameter of the tube 12 along which are aligned the opposite dimples 22 drawn by the protuberances or knobs 48 of the rolls 42 and 44, each roll of a pair of rolls being in phase with the opposite roll and each pair of opposite rolls being 90° out-of-phase with the adjacent pairs. The result is that the distance between opposite pair of dimples 22 is substantially constant and that a pair of opposite dimples is formed alternatively along diameters of the tube 12 perpendicular to each other. At the start of a run, a removable annular spacer 62, FIG. 5, may be used to hold the leading end of the inner tube 14 within the leading end of the outer tube 12 until at least a pair of opposite dimples 22 have been formed by the rolls 38–44.

Alternatively, the dimples 22 may be formed by means of a die, not shown, having an elongated bore through which the outer tube 14 with the inner tube 12 placed within the outer tube, is fed, the die peripheral surface being provided with regularly spaced pairs of opposite reciprocating forming punches.

By means of the method and apparatus of the invention, heat transfer tubes according to the structure of the invention may be made in any appropriate lengths and in any appropriate sizes in the range of a few millimeters to several meters in outside diameters. As an example of convenient dimensions, given for illustrative purpose only, heat transfer tubes according to the invention and consisting of 27.5 mm. outside diameter copper seamless tubing having a 0.9 mm. wall thickness provided with an inner tube made of copper seamless tubing of 19 mm. outside diameter and having a double wall of about 1.3 mm. total thickness are manufactured by means of the method and apparatus of the invention by drawing dimples to a depth of about 5.55 mm., which in turn causes the surface of the inner tube to be correspondingly embossed to a depth of about 1.3 mm. Such dimensions provide an annular space 16 for the passage of a fluid having a cross-sectional area equal to the cross-sectional area of the inner passageway through the interior 28 of the inner tube 14. It will be appreciated that varied proportions or ratios of internal fluid flow passage cross-areas may be obtained according to the specific applications or to match the heat carrying capacity of the fluids, and that preferably, when used as a heat exchanger, the heat transfer tubes 10 of the invention may be encased in a sleeve of heat-insulating material, as shown at 80 at FIG. 3, such as asbestos for example, to prevent heat losses through convection to the ambient across the wall of the outer tube 12.

In use, the heat transfer tubes 10 of the invention are cut to an appropriate length, first by effecting a cut through both the peripheral or outer tube 12 and the inner tube 14, and subsequently effecting a cut only through the wall of the outer tube 12, as shown at 63 at FIG. 3, thus leaving on one end, or both ends as desired, a projecting end portion 64 of the inner tube 14 beyond the cut end 63 of the outer tube 12. A T-shaped connector 66, for example, has an end 68 fitted over one cut end 63 of the outer tube 12 and soldered or brazed in position. The connector 66 has another end 70 of reduced diameter fitting the outer diameter of the inner tube 14 at an end projecting portion 64, soldered or brazed thereto, which provides a soldered or brazed junction with an inlet, or outlet, conduit 72 for the fluid circulating through the inner tube 14. The other end 74 of the T-shaped connector 66 may be connected to a fluid inlet or outlet, as the case may be, or connected in the same manner to another length of heat transfer tube 10, either in series or in parallel, as desired for fabricating heat exchanger units of greater capacity than provided by a single length of heat transfer tube. A projecting end portion 64 of the inner tube 14 may, alternatively, be but with a sufficient length to project through the end 70 of a T-shaped connector similar to the connector 66 but not provided with an internal annular abutment 76, and provided with an appropriate conventional straight or elbow connector soldered or brazed in place and forming an inlet or an outlet, as the case may be, for a fluid circulating through the interior 28 of the inner tube 14.

Having thus described the present invention by way of a structural example thereof, and by an example of the apparatus and method of manufacture, modification whereof will be apparent to those skilled in the art, what is claimed as new is as follows:

1. A heat transfer tube comprising a first metallic tubular conduit member having a cylindrical wall, a second metallic tubular conduit member having a cylindrical wall concentrically disposed within said first metallic tubular conduit member, said second tubular member comprising a pair of tubular conduits disposed one within the other, the exteriorly disposed tubular conduit being shrunk onto the interiorly disposed conduit such as to provide said second tubular member with a double wall thickness and the cylindrical wall of said first tubular conduit member having an inner surface of a diameter greater than the outer surface of the cylindrical wall of said second tubular conduit member such that a substantially annular conduit is formed between the outer surface of said second tubular conduit member and the inner surface of said first tubular conduit member, a plurality of substantially dome-shaped concave first dimples formed in the wall of said first tubular conduit member and having each a convex top portion projecting radially and inwardly into the wall of said second tubular conduit member, a plurality of corresponding substantially dome-shaped concave second dimples formed in the wall of said second tubular conduit member and projecting radially and inwardly in said second tubular conduit, said radially and inwardly projecting convex top portion of each of said substantially dome-shaped first dimples being firmly engaged in one of said dome-shaped concave second dimples in the wall of said second tubular conduit member, thereby forming a sturdy and rigid assembly of said first and second tubular conduit members by said dome-shaped complementary concavely recessed dimples in the wall of said first tubular conduit member and in the wall of said second tubular conduit member for securely locking and holding said second tubular conduit member within said first tubular conduit member by forced engagement of the top convex portion of each first dimple in the wall of said first tubular conduit member into a corresponding concavely recessed second dimple in the wall of said second tubular conduit member.

2. The heat transfer tube of claim 1 wherein pairs of said first and second interlocked dimples are disposed along a diameter of said heat transfer tube and each diameter axis of each pair of said first and second interlocked dimples is at substantially right angle to the diameter axis of adjoining pairs.

3. The heat transfer tube of claim 1 further comprising an elbow connector mounted on at least one end of said heat transfer tube, said elbow connector having an aperture through a wall thereof affording passage to a projecting length of said second tubular member and forming a connecting passageway for said generally annular conduit between the exterior wall surface of said second tubular member and the interior wall surface of said first tubular member.

4. A heat transfer tube comprising a first tubular member having a cylindrical wall defining an interior wall surface and an exterior wall surface, a second tubular member disposed substantially concentric within said first tubular member and having a cylindrical wall defining an interior wall surface and an exterior wall surface, the exterior wall surface of said second tubular member being spaced apart from the interior wall surface of said first tubular member and defining therebetween a generally annular conduit, and a plurality of substantially regularly spaced dome-shaped dimples each formed in the wall of said first tubular member and having a convex top end portion extending into the wall of said second tubular member, said convex top end portion of each of said dome-shaped dimples being firmly engaged in and interlocking with a corresponding recess formed in the wall of said second tubular member, the dome-shaped dimples formed in the wall of said first tubular member and the corresponding recesses formed in the wall of said second tubular member being diametrally disposed by pairs and each pair having an axis at right angle to the axis of an adjoining pair, wherein each of said dome-shaped dimples is formed as an inwardly-directed radial deformation of the wall of said first tubular member and its convex top end portion is forcibly engaged in said recess in said second tubular member wall, and said recess is a dimple also formed as an inwardly-directed radial deformation in the wall of said second tubular member having a dome-like concave shape complementary of said convex top end portion of each of said dome-shaped dimples formed in the wall of said first tubular member, wherein said first and second tubular members are prevented from longitudinal and rotational relative motion and said generally annular conduit is formed between the exterior wall surface of said second tubular member and the interior wall surface of said first tubular member and wherein said second tubular member comprises a pair of tubular conduit members disposed one within the other, the exteriorly disposed tubular conduit member being shrunk onto the interiorly disposed conduit member such as to provide said second tubular member with a double wall thickness.

5. The heat transfer tube of claim 4 further comprising an elbow connector mounted on at least one end of said heat transfer tube, said elbow connector having an aperture through a wall thereof affording passage to a projecting length of said second tubular member and forming a connecting passageway for said generally annular conduit between the exterior wall surface of said second tubular member and the interior wall surface of said first tubular member.

6. A heat transfer tube comprising a first tubular member having a cylindrical wall defining an interior wall surface and an exterior wall surface, a second tubular member disposed substantially concentric within said first tubular member and having a cylindrical wall defining an interior wall surface and an exterior wall surface, the exterior wall surface of said second tubular member being spaced apart from the interior wall surface of said first tubular member and defining therebetween a generally annular conduit, and a plurality of substantially regularly spaced dome-shaped dimples each formed in the wall of said first tubular member and having a convex top end portion extending into the wall of said second tubular member, said convex top end portion of each of said dome-shaped dimples being firmly engaged in and interlocking with a corresponding recess formed in the wall of said second tubular member, the dome-shaped dimples formed in the wall of said first tubular member and the corresponding recesses formed in the wall of said second tubular member being diametrally disposed by pairs and each pair having an axis at right angle to the axis of an adjoining pair, whereien each of said dome-shaped dimples is formed as an inwardly-directed radial deformation of the wall of said first tubular member and its convex top end portion is forcibly engaged in said recess in said second tubular member wall, and said recess is a dimple also formed as an inwardly-directed radial deformation in the wall of said second tubular member having a dome-like concave shape complementary of said convex top end portion of each of said dome-shaped dimples formed in the wall of said first tubular member, whereby said first and second tubular members are prevented from longitudinal and rotational relative motion and said generally annular conduit is formed between the exterior wall surface of said second tubular member and the interior wall surface of said first tubular member, said heat transfer tube further comprising an elbow connector mounted on at least one end of said heat transfer tube, said elbow connector having an aperture through a wall thereof affording passage to a projecting length of said second tubular member and forming a connecting passageway for said generally annular conduit between the exterior wall surface of said second tubular member and the interior wall surface of said first tubular member.

* * * * *

UNITED STATES PATENT AND TRADEMARK OFFICE

CERTIFICATE OF CORRECTION

PATENT NO. : 4,585,059

DATED : April 29, 1986

INVENTOR(S) : Marlow Lee

It is certified that error appears in the above-identified patent and that said Letters Patent are hereby corrected as shown below:

Col. 5, line 18, change "but" to --cut--.

Col. 6, line 50, change "wherein" to --whereby--.

Signed and Sealed this

Twenty-first Day of October, 1986

[SEAL]

*Attest:*

DONALD J. QUIGG

*Attesting Officer* *Commissioner of Patents and Trademarks*